United States Patent [19]

Linday

[11] Patent Number: 4,986,458

[45] Date of Patent: Jan. 22, 1991

[54] INFANT CARRIER

[76] Inventor: Linda A. Linday, 340 W. 55th St. 9B, New York, N.Y. 10019

[21] Appl. No.: 232,689

[22] Filed: Aug. 16, 1988

[51] Int. Cl.[5] ..... A45F 3/04

[52] U.S. Cl. ..... 224/160; 224/216

[58] Field of Search ..... 224/153, 158, 159, 160, 224/161, 195, 197, 202, 206, 209, 213, 215, 216, 224, 257, 259, 260, 264, 151, 157, 185, 196, 199, 201, 204, 205, 207, 208, 211, 214, 253, 255

[56] References Cited

U.S. PATENT DOCUMENTS

| | | | |
|---|---|---|---|
| 874,945 | 12/1907 | Davey | 224/216 |
| 1,109,065 | 9/1914 | Heath et al. | 224/159 |
| 2,550,851 | 5/1951 | Nichols | 224/151 |
| 3,481,517 | 12/1969 | Aukerman | 224/160 |
| 3,536,237 | 10/1970 | Greenman | 224/264 |
| 4,139,131 | 2/1979 | Hathaway | 224/160 |
| 4,234,229 | 11/1980 | Arnold | 224/160 |
| 4,271,998 | 6/1981 | Ruggiano | 224/160 |
| 4,434,920 | 3/1984 | Moore | 224/160 |
| 4,436,233 | 3/1984 | Hill et al. | 224/159 |
| 4,467,945 | 8/1984 | Schaapveld | 224/160 |
| 4,492,326 | 1/1985 | Storm | 224/160 |
| 4,836,428 | 6/1989 | Evans et al. | 224/253 |

FOREIGN PATENT DOCUMENTS

| | | | |
|---|---|---|---|
| 1215795 | 4/1960 | France | 224/159 |
| 259005 | 12/1948 | Switzerland | 224/215 |
| 6801 | of 1888 | United Kingdom | 224/216 |
| 22099 | of 1895 | United Kingdom | 224/209 |
| 449569 | 6/1936 | United Kingdom | 224/161 |
| 2076636 | 12/1981 | United Kingdom | 224/153 |

OTHER PUBLICATIONS

Snugly "Handbook" (1981).
Gerry Escort Baby Carrier (date unknown).
Advertisement Snugly Padded Infant Carrier (1988).
Lookabout Carrier advertisement–Sensational Beginnings (date unknown).
Sara's Ride Comfortable Carrier (1984).
Aviator Baby Carrier advertisement (1987).
Advertisement–Papoose Baby Carrier (date unknown).
Instructions for Papoose Baby Carrier (date unknown).
Century Kangourou Package (1986).
Baby Matey Literature (date unknown).
Baby Carrier from Catalog Baby Bjorn (date unknown).
Baby Bear Carrier advertisement–(Hearth Song Catalogue, Jan. 1988).

*Primary Examiner*—Ernest G. Cusick
*Assistant Examiner*—Robert M. Fetsuga
*Attorney, Agent, or Firm*—Ladas & Parry

[57] ABSTRACT

An infant carrier having an infant supporting pouch and a harness permitting the carrier to be worn by an adult. The harness comprises adjustable shoulder straps and an adjustable girth strap so arranged as to enable the carrying pouch to be switched from a position of frontal support to a position of side support while the harness is on a wearer and while the child remains in the pouch. The carrier may also be used to carry an infant on the back of the wearer.

12 Claims, 3 Drawing Sheets

INFANT CARRIER

BACKGROUND OF THE INVENTION

The invention relates to an infant carrier of the soft type in which an infant is supported in a pouch which is then slung from the shoulders of an adult carrier. The infant is retained in an upright, usually sitting, position by virtue of the sling support depending from the carrier's shoulders. However, the weight of the infant is distributed so that the majority of the weight is not borne by the shoulders which would not only be uncomfortable but would readily impart fatigue to the carrier. Instead, the majority of the weight of the infant is borne by the lower torso, especially the hips.

The infant carrier of the invention enables an adult comfortably to carry a child in a variety of circumstances, for example, around the house, when shopping, in fact whenever walking or standing is involved.

Infant carriers are generally of two types, namely soft carriers and frame carriers. Soft carriers are known in which an infant is supported on the front, side or back of a wearer, whereas frame carriers lend themselves to supporting an infant on the back of a wearer.

While there are distinct advantages to each type of carrier, it has hitherto not been possible readily to switch from one carrying position to the other, particularly while the carrier is in use with an infant. supported in the pouch.

U.S. Pat. Nos. 4,434,920 and 4,492,326 are examples of infant carriers in which the infant is supported in front of the adult carrier. U.S. Pat. No. 4,436,233 is an example of an infant carrier where the infant is slung to one side of the adult and U.S. Pat. No. 3,481,517 is an example of a rear infant carrier.

SUMMARY OF INVENTION

In addition to the prior art exemplified in the above identified U.S. patents, infant carriers have been marketed which are capable of carrying a child on the front, back or side of an adult carrier. However, although separate positions of support may be adopted, in order to switch from one position to another it has hitherto been necessary first to remove the child from the carrier and then to rearrange the carrier as necessary before replacing the child in a carried position.

It is an object of the invention to provide an infant carrier in which a supported child can be moved, at will, from a position of frontal support to a position of side support. At all times during such movement, the infant remains snugly and securely seated in the pouch.

It is a further object of the invention to provide an infant support where the weight of a supported infant is properly distributed to cause minimal inconvenience or discomfort to an adult carrier.

According to the present invention there is provided an infant carrier including a pouch having upper left and right corners and a transversely extending lower edge, and a harness attached to said pouch and including shoulder strap means and girth strap means, wherein said shoulder strap means includes a first shoulder strap secured at one end to said pouch in the region of said upper left corner and extending diagonally down and across said pouch to a location in the region of the right end of said lower edge at which the other end of said first strap is secured to said pouch and a second shoulder strap secured at one end to said pouch in the region of said upper right corner and extending diagonally down and across said pouch to a location in the region of the left end of said lower edge at which the other end of said second strap is secured to said pouch, and wherein said girth strap means has opposite end portions extending respectively outwardly from said lower edge of the pouch and cooperating coupling means operable to couple said opposite end portions whereby said pouch may be slung in selected positions, said selected positions including on the front and on the side of the wearer.

According to a preferred embodiment of the invention there is provided an infant carrier adaptable to support an infant selectively and interchangeably on the front or on the side of an adult, said carrier including a child supporting flexible pouch and an integral harness, wherein the harness includes adjustable shoulder straps and an adjustable girth strap and said pouch has draw cord means for adjusting the configuration of the pouch, wherein said adjustable shoulder straps including first and second straps respectively extending diagonally across the pouch from points of attachment proximate top and bottom left and right corners of the blank, and wherein a bottom edge of the blank is folded over to form a sheath slidably to accommodate the girth strap, said girth strap having complimentary coupling members adjustably located toward the outer free ends thereof to permit said girth to be coupled to provide a lower torso encircling loop.

A preferred embodiment of the invention will now be described by way of example and with reference to the accompanying drawings.

INTRODUCTION TO THE DRAWINGS

DETAILED DESCRIPTION OF PREFERRED EMBODIMENT

Figure 1:
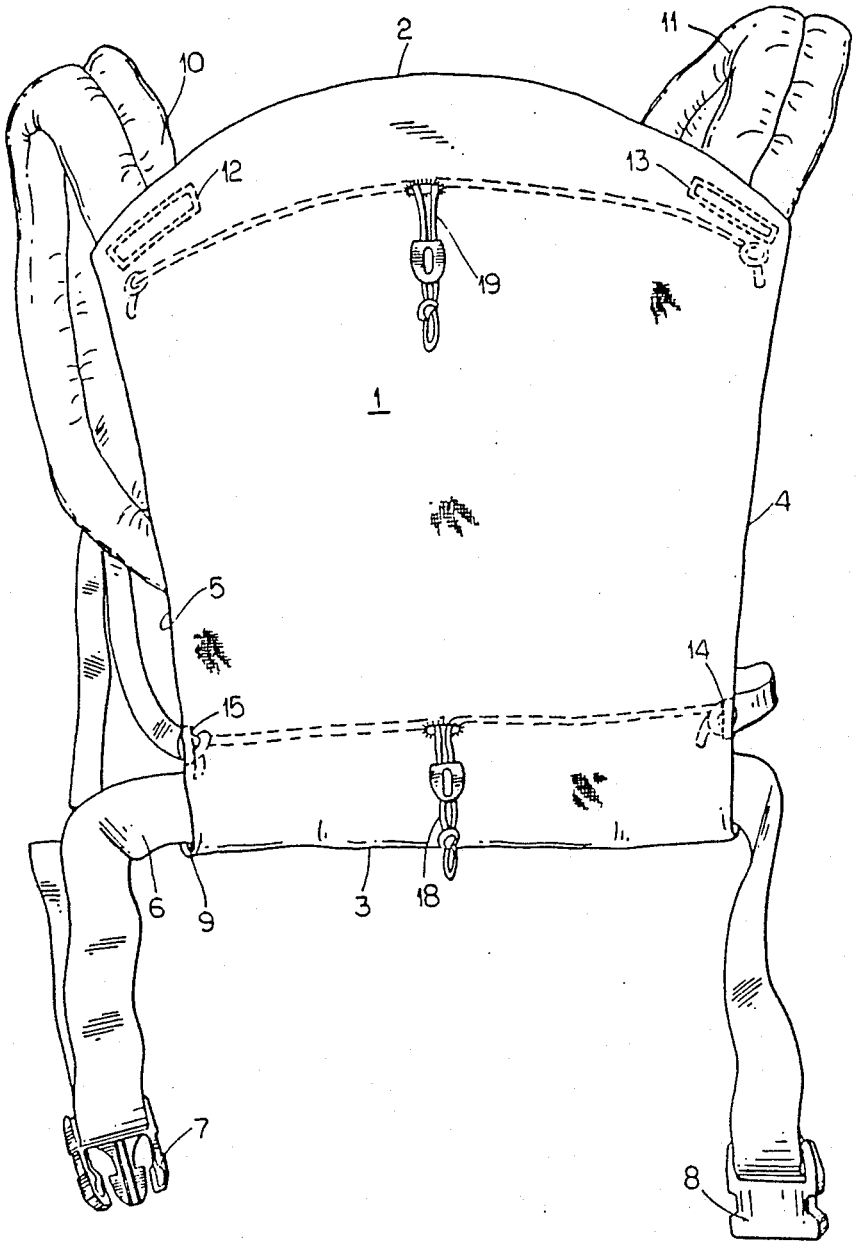
FIG. 1 is a front elevational view of an infant carrier of the invention.

The infant carrier of the invention comprises a pouch 1 of fabric or like flexible material. The pouch is advantageously made from a blank of canvas, cloth or like material but can also be a fabric of synthetic fibers. The pouch is shaped from a blank having an upper margin 2, a lower margin 3 and side margins 4 and 5. A girth strap 6 extends laterally outwardly from the lower margin 3 and has complimentary buckle portions 7, 8 attached to opposite ends thereof. The girth strap 6 is advantageously encased in and extends through a sheath or sleeve 9 formed by folding over the lower margin and attaching the folded over portion to the main body portion of the blank by stitching. In this manner the girth strap is free to slide within the sheath permitting transverse movement of the pouch 1 along the girth strap 6. As will be explained hereinafter, this finds particular advantage when switching the infant carrier from a position of frontal support to a position of side support. Notwithstanding this preferred mode of attaching the girth strap 6 to the pouch 1, other means of attachment, such as stitching would be possible if somewhat less convenient in use.

Twin shoulder straps are provided, a first strap 10 being secured at or toward one upper corner of the pouch and extending diagonally downwardly toward the opposite lower corner and the second strap 11 being similarly secured at or toward the opposite upper corner and extending diagonally down toward the opposite lower corner. The shoulder straps 10, 11 are most conveniently secured at their upper ends by stitching as depicted at 12 and 13 whereas the lower ends of the respective straps may similarly be attached by stitching 14, 15. As most clearly shown in FIG. 2 of the drawings, the lower ends of the shoulder straps are attached toward the bottom corners of the pouch but above that portion of the sheath 9 within which the girth strap 6 is slidably mounted.

Figure 2:
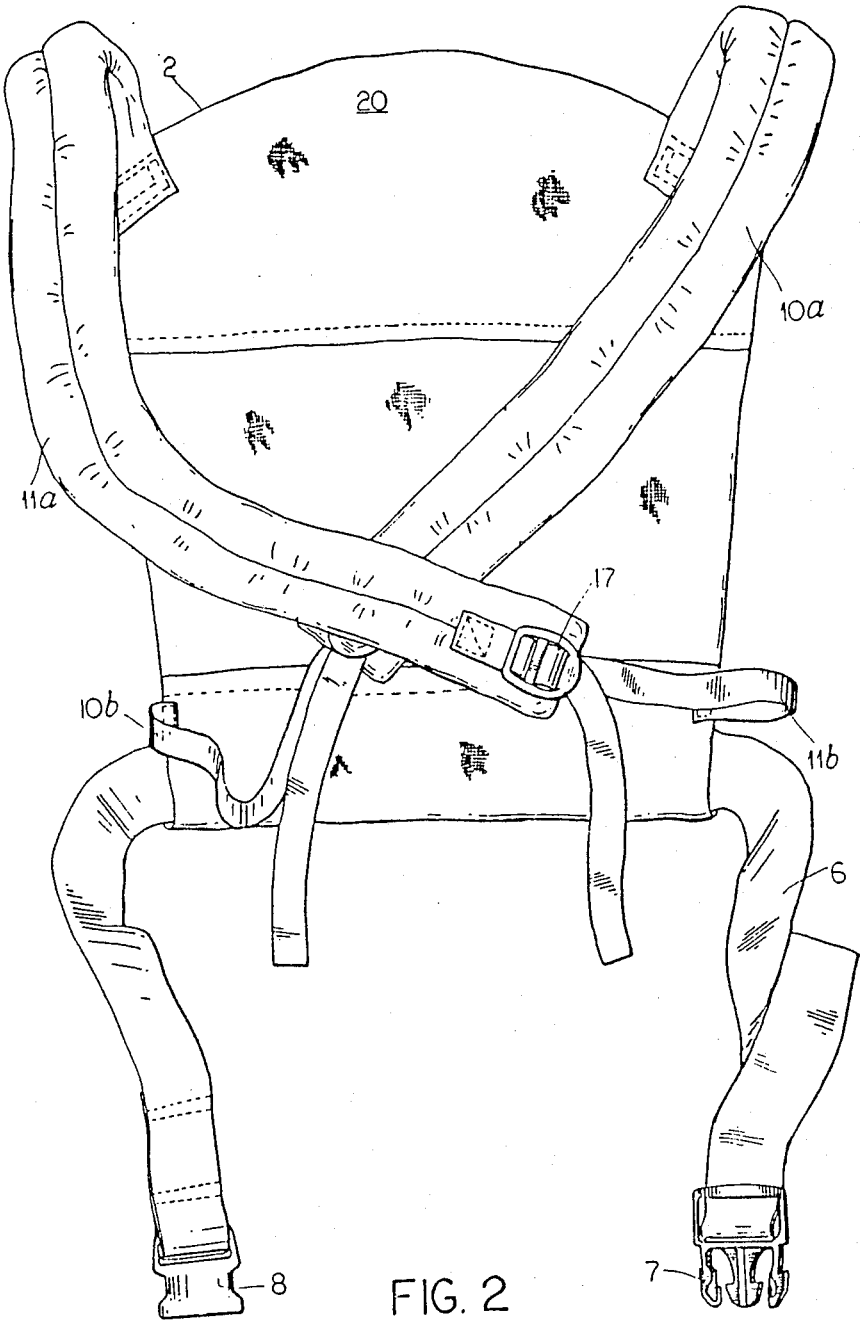
FIG. 2 is a rear view of the carrier shown in FIG. 1.

As shown most clearly in FIG. 2 of the drawings, each shoulder strap has two parts, namely an upper part 10A, 11A and a lower part 10B, 11B interconnected by adjustable fasteners 16, 17. The upper parts which in use pass over the shoulders of an adult are advantageously padded to afford greater comfort. In the preferred embodiment each fastener comprises a double loop plastics buckle anchored to the upper part of the shoulder strap and an adjustable strap length comprising the lower part of the shoulder strap which is threaded through the double buckle in such manner that the free end of the lower strap parts may be pulled to tighten, and thereby shorten, the shoulder straps and will retain the tightened position once the pulling force is relaxed. Loosening is effected by flipping up the edge of the buckle.

Additional features of the infant carrier will be described in the following paragraphs of this description. First, however, the donning and use of the infant carrier will be described.

In order to don the infant carrier, the carrier is held or laid out substantially in the position shown in FIG. 2 of the drawings. FIG. 2 is a rear view and the carrier is then suspended in an upside-down position in front of a wearer with the girth strap located at the level of the wearer's waist. In this position the upper margin 2 of the pouch extends down towards the knees of the wearer and the front side (FIG. 1) of the pouch overlies the wearer's thighs and the rear side of the pouch (FIG. 2) is directed away from the wearer. The girth strap is then led around the waist of the wearer and the cooperating buckle portions 7, 8 are engaged and snapped one within the other to secure the strap around the waist of the wearer. Thereupon the pouch and shoulder straps are raised from the depending suspended position and the wearer inserts his or her head and arms through the crossed straps to assume the position most clearly shown in the FIG. 4 of the drawings. Having adopted this position, minor adjustment of the adjustable shoulder straps and also girth strap is effected prior to seating an infant in the pouch after which final tightening adjustment of the straps is effected.

Figure 4:
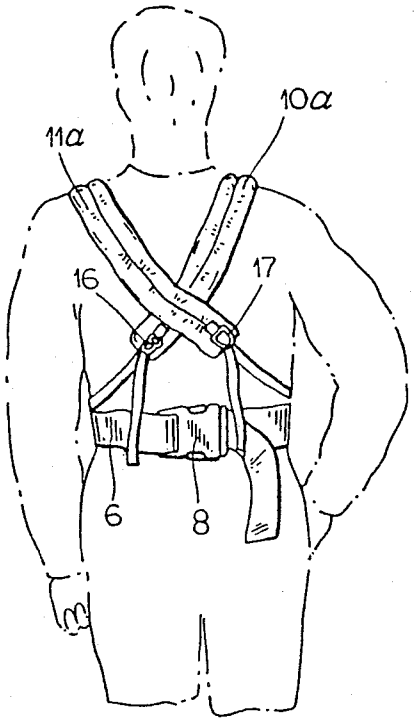
FIG. 4 is a rear view of the person shown in FIG. 1.
Figure 3:
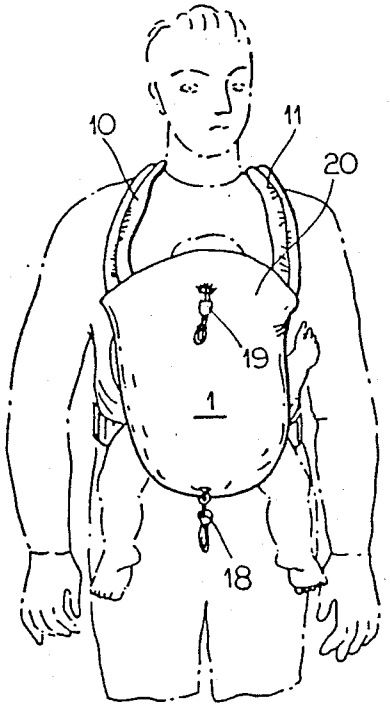
FIG. 3 is a front view of a person supporting the infant carrier slung in a frontal position.

In the frontal support position shown in FIGS. 3 and 4 of the drawings, the infant is seated and supported facing the chest of the wearer with the legs of the infant depending downwardly and bending comfortably at the knee. In the case of older children the legs of the child while flexing at the knees will tend to wrap around the waist of the wearer thereby affording a comfortable support and freedom of movement to the wearer. In the case of extremely young infants, the infant can be accommodated in the natural fetal position with the legs tucked in and covered by the pouch. In all cases the weight of the infant is primarily distributed about the hips of the wearer and the pouch and associated shoulder straps afford support in the carried position but transmit relatively small bearing weight to the shoulders of the wearer. The padded upper parts 10A, 11A of the shoulder straps advantageously have sufficient width and length to distribute part of the weight not only on the shoulders but also across the back of a wearer. It will therefore be apparent that the infant carrier affords substantial comfort both to the infant and to the adult carrier.

Figure 5:
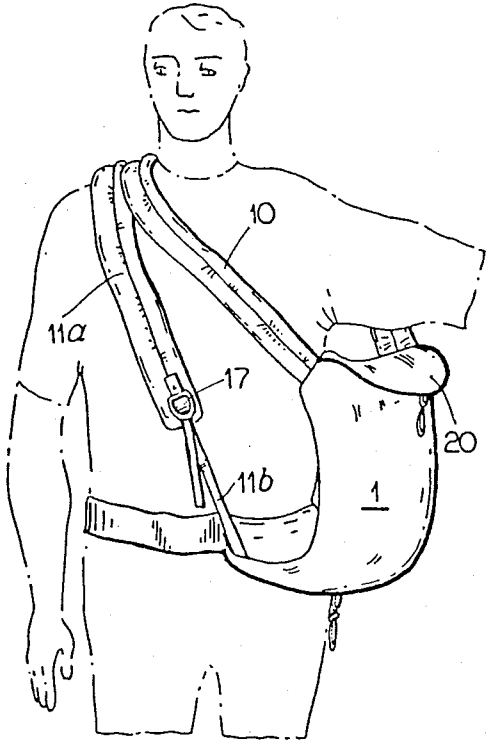
FIG. 5 is a front view of a person supporting the infant carrier slung in a side supporting position.

FIG. 5 of the drawings shows an alternative support position where the infant is slung to the side of the adult carrier and, again, the weight of the carried infant is distributed generally to the hip of the wearer. While FIG. 5 of the drawings shows the infant supported to the left side of the wearer, it will be appreciated that a mirror image can equally readily be adopted whereby the infant is slung on the right side of the adult carrier.

A particular advantage of the infant carrier described in the preceding paragraphs and shown in the accompanying drawings is that the slung carrier can readily be switched between the alternative positions shown in FIGS. 3 and 5 of the drawings while an infant is supported within the pouch. To do this, it is neither necessary to remove the infant nor to unbuckle or otherwise disconnect the supporting straps. Transfer from, for example, the frontal support position of FIG. 3 to the side support position of FIG. 5 is effected simply by slipping the left hand shoulder strap 11 off the left shoulder and allowing the strap to dangle down the left arm of the wearer. Thereupon, the entire carrier pouch is slid laterally around the wearer's body from right to left with respect to the wearer. That is to say, viewing the wearer from the front as shown in FIG. 3 of the drawings, the pouch 1 is slid to the right as shown in that figure. This lateral sliding is made possible due to the fact that the girth strap 6 can slide freely within the sheath 9 formed along the bottom of the pouch 1.

When the pouch has adopted a position resting on the wearer's left hip as shown in FIG. 5, the wearer reaches his or her right arm behind him or her and inserts that arm through the loosely dangling shoulder strap and lifts that strap up into the supported position shown in FIG. 5 of the drawings where both shoulder straps pass over the wearer's right shoulder.

The ease with which this transfer in position can be accomplished represents a striking advantage of the present invention and enables a supported child to be moved from a frontal supporting to a side supporting position, thereby affording the wearer unimpeded access forwardly or, alternatively, the infant may be transferred from a frontal supporting to a side supporting position simply to adjust the supporting load borne by the wearer. The transition is so easy and smooth that a sleeping infant is not disturbed. Another reason for switching a child from a frontal support position to a side support position is to enable the child to see forwardly. It will readily be appreciated that by unslinging the right hand shoulder strap and swiveling the pouch to the wearer's right hip, the infant carrier can be transferred from the frontal position shown in FIG. 3 to a position representing a mirror image to that shown in FIG. 5 in which the pouch is supported on the wearer's right hip.

Reference to the drawings, particularly FIGS. 1 and 3, shows draw strings 18, 19 extending through slots within the pouch. The draw string 18 serves to adjust that portion of the pouch which supports the seat of an infant seated within the pouch whereas the draw string 19 may be drawn to tighten a head support flap 20 snugly to accommodate the infant. FIG. 3 shows the head supporting flap in a drawn supporting position whereas FIG. 5 shows the string slackened and the flap 20 folded down. With the string 19 tightened, the head flap adopts a supporting position whereas with this string slackened and the head flap folded over as shown in FIG. 5 an older child is able to see around with substantially unimpeded view.

Adjustment of the straps is readily accomplished and facilitated by virtue of the fact that the ends of the straps hang free from the adjustment buckles and are easily accessible.

The readily adjustable shoulder and girth straps, as well as the adjustable pouch size and head support, not only permit drawing the straps to a snug supporting position but also ensure that the infant carrier can be adjusted to the size of the adult carrier and, consequently, one carrier is suitable for all sizes not only of adult carrier but also of infant carried.

From the foregoing it will be appreciated that both in the frontal and side support positions, there are at all times two shoulder straps which impart both security to the infant carried and comfort to the adult carrier.

I claim:

1. An infant carrier including a pouch having upper left and right corners and a transversely extending lower edge, and a harness attached to said pouch and including shoulder strap means and girth strap means, wherein said shoulder strap means includes a first shoulder strap secured at one end to said pouch in the region of said upper left corner and extending diagonally down and across said pouch to a location in the region of the right end of said lower edge at which the other end of said first strap is secured to said pouch and a second shoulder strap secured at one end to said pouch in the region of said upper right corner and extending diagonally down and across said pouch to a location in the region of the left end of said lower edge at which the other end of said second strap is secured to said pouch, and wherein said girth strap means is independently slidable within a sheath formed along said lower edge of the pouch and has cooperating coupling means operable to couple opposite end portions of said girth strap means extending from said sheath, whereby said pouch may be slung in selected positions including on the front, back and on the side of the wearer, and whereby said pouch may be transferred from one selected position to another while it is supported on the wearer by one of said shoulder straps and said girth strap, said transfer being facilitated by the slidable relationship between said girth and said sheath.

2. An infant carrier according to claim 1, wherein the shoulder straps are arranged to extend one over each shoulder of a wearer when the pouch is slung in a front or in a back position.

3. An infant carrier according to claim 1, wherein the first and second shoulder straps are arranged to extend both over the same shoulder of a wearer when the pouch is slung in a side position, said same shoulder being the opposite shoulder from the side of the wearer on which the pouch is slung.

4. An infant carrier according to claim 1, wherein the shoulder strap means is adjustable.

5. An infant carrier according to claim 4, wherein each of said first and second shoulder straps is in two distinct parts, said parts being coupled intermediate the secured ends by an adjustable coupling.

6. An infant carrier according to claim 5, wherein one of said distinct parts is dimensioned to extend over the shoulder of a wearer and is padded.

7. An infant carrier according to claim 1, wherein the girth strap means is a single strap longitudinally slidably accommodated in said sheath which extends transversely at least part way along the lower edge of the pouch.

8. An infant carrier according to claim 7, wherein the coupling means on the girth strap includes a tongue adjustably mounted on one strap portion and a cooperating receiving socket on the other strap portion.

9. An infant carrier according to claim 1, wherein a draw cord extends transversely through the lower region of the pouch.

10. An infant carrier according to claim 1, wherein an upper edge of the pouch extending between the upper left and right corners defines a head supporting flap.

11. An infant carrier according to claim 11, wherein a draw cord extends transversely through the upper region of the pouch to adjust the head supporting flap.

12. An infant carrier adaptable to support an infant selectively and interchangeably on the front or on the side of a wearer, said carrier including a child supporting flexible pouch, formed from a fabric blank, and an integral harness, wherein the harness includes adjustable shoulder straps and an adjustable girth strap and said pouch has draw cord means for adjusting the configuration of the pouch, said pouch being adapted to be slung in selected positions including the front and the side of the wearer, wherein said adjustable shoulder straps including first and second straps respectively extending diagonally across the pouch from points of attachment proximate top and bottom left and right corners of the pouch, and wherein a bottom edge of the blank is folded over to form a sheath slidably to accommodate the girth strap, said girth strap having complimentary coupling members adjustably located toward the outer free ends thereof to permit said girth to be coupled to provide a lower torso encircling loop, whereby said pouch may be transferred from one selected position to the other while it is supported on the wearer by one of said shoulder straps and said girth strap, said transfer being facilitated by said slidable accommodation of the girth strap in the sheath.

* * * * *